United States Patent [19]

Fekete

[11] Patent Number: 4,740,141

[45] **Date of Patent: * Apr. 26, 1988**

[54] PLUNGER WITH COMPOSITE RETENTION VALVE

[75] Inventor: Amnon V. Fekete, Miranda, Venezuela

[73] Assignee: Intevep, S.A., Caracas, Venezuela

[ * ] Notice: The portion of the term of this patent subsequent to May 27, 2003 has been disclaimed.

[21] Appl. No.: 867,117

[22] Filed: May 23, 1986

Related U.S. Application Data

[63] Continuation-in-part of Ser. No. 427,157, Sep. 9, 1982, Pat. No. 4,591,315.

[51] Int. Cl.[4] ..... F04B 3/00; F04B 7/00

[52] U.S. Cl. ..... 417/259; 417/513; 92/168

[58] Field of Search ..... 92/168; 417/511–514, 417/259, 520, 486–488

[56] References Cited

U.S. PATENT DOCUMENTS 4,436,494 3/1984 Yamaizumi ..... 417/511 X
4,591,315 5/1986 Fekete ..... 417/259

*Primary Examiner*—William L. Freeh
*Assistant Examiner*—Ted Olds
*Attorney, Agent, or Firm*—James G. Staples

[57] ABSTRACT

A pump is disclosed comprising a piston plunger with a valve disposed in it. The ratio of the flow area on either side of the valve is optimized.

4 Claims, 1 Drawing Sheet

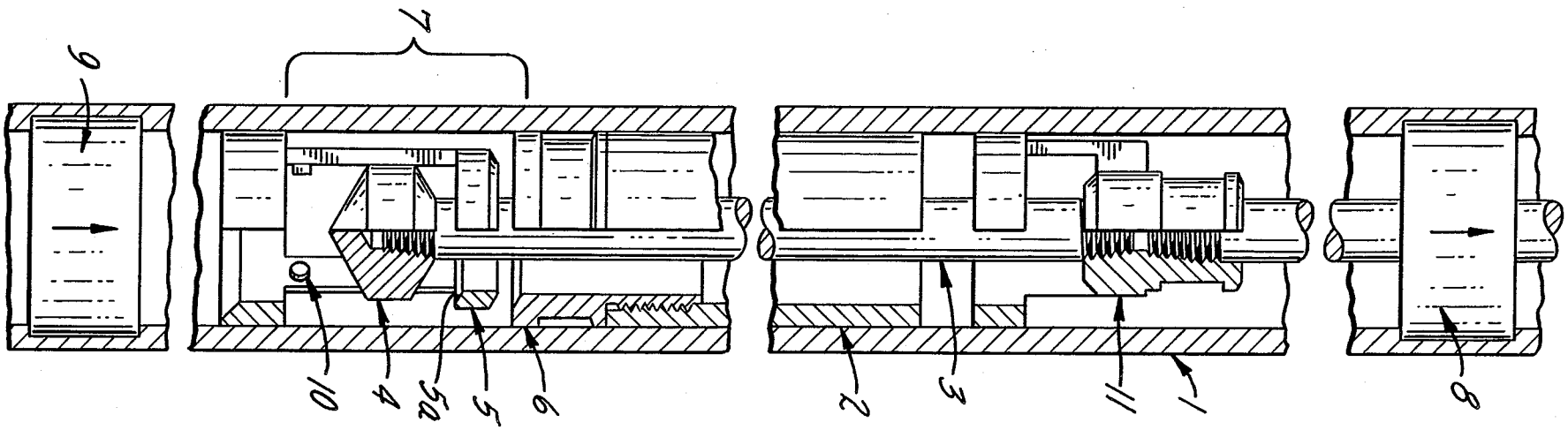
8
1
11
3
2
6
5
5a
4
10
7
9

PLUNGER WITH COMPOSITE RETENTION VALVE

This application is a continuation-in-part of pending application Ser. No. 427,157, filed Sept. 9, 1982, now U.S. Pat. No. 4,591,315, issued May 27, 1986.

This invention relates generally to positive displacement pumps or compressors. It is directed more specifically to overcoming functional limitations often associated with the plunger used in such pumps or compressors. For convenience of reference, the term "pump" used hereafter will include within its scope both pumps and compressors which operate on the principle of positive displacement.

SUMMARY OF THE INVENTION

The invention is directed, firstly, to providing a pump having an optimum pressure ratio and, secondly, to maximizing the area of possible flow of the fluid being pumped through a composite retention valve located in the pump plunger.

The plunger which meets the objectives of the present invention is constituted by a cylindrical body which is displaced within another cylinder, a stem which transmits a reciprocating movement to a plug which contacts via a plug ring (or several plug rings) via a seat therein, which plug ring is turn can come in contact with a cylindrical body through another seat, in one direction, and, through any other method which may transmit the movement of the stem to the cylindrical body in the other direction.

The plunger of this invention, together with a retention valve secured to the cylinder within which the piston is displaced, will constitute a pump which may be used for pumping very viscous fluids which may or may not contain suspended solids and/or dissolved gases and/or steam.

In the event that the pumping conditions are such that there is a high counter pressure and a high amount of gases and/or steam in the pumped fluid, then another retention valve may optionally be used. This optional retention valve would be fixed to the cylinder and located after the discharge end of the plunger. In other words, the plunger would reciprocate between the two retention valves.

For a better understanding of this invention, a possible embodiment of it and its operation will be described when the invention forms part of a pump, with the understanding that this presentation is merely for explanatory purposes and is in no way limitative.

BRIEF DESCRIPTION OF THE DRAWING

The FIGURE is a diagram of the component parts of the present invention.

DETAILED DESCRIPTION OF THE INVENTION

FIG. 1 represents a possible design of the plunger which is the subject of this invention. The plunger reciprocates inside a cylinder 1 and is formed by a cylindrical body 2, a stem 3, a plug 4, a plug ring 5, a plug seat 5*a*, and a seat 6 for the plug ring 5. The plug 4, the plug ring 5 and the seat 6 constitute the traveling retainer valve 7.

Since the traveling valve 7 is located in the suction end of the plunger, the pressure ratio in the pump is optional.

The free space between the stem 3 and the interior of the cylindrical body 2 is the only factor which limits the flow area through the piston.

The invention is illustrated as applied to pumps in which the stem is moved reciprocally in a vertical direction, like in the down hole pumps used in the petroleum industry. The following explanation of the operation is applicable to all pumps using the principle of positive displacement. If the stem 3 is moved in a direction other than vertical, then only the gravitational components which operate in the vertical direction need to be considered.

During the operation of the pump, when the stem 3 commences to descend from the extreme upper position, the annular retention valve 8 (secured to the cylinder 1 on the discharge side of the plunger, and which is optionally used when there is high counterpressure and a high content of gases and/or steam dissolved in the fluid) closes. Closure of valve 8 starts to support the counterpressure effects and the effects of the weight of the fluid column located above the valve; meanwhile, the plunger descends by the mechanical action of the stem 3, aided by the action of the weight of the reduced fluid column located between the traveling valve 7 and the annular valve 8 or by the entire fluid column when the annular valve 8 is not used, until the increase of the pressure between the traveling retention valve 7 and the standing valve 9 (secured to the cylinder 1 on the suction side of the plunger) and primarily the friction between the cylindrical body 2 of the plunger and the cylinder l, detain the movement of said cylindrical body 2. When the latter is detained, the plug 4, which is secured to the stem 3, is separated from its seat 5*a* in the plug ring 5. Once this occurs, the plug ring 5 is separated from its seat 6 in the cylindrical body 2 by effects of gravity and/or by any other means such as screws 10, which transmits to it the descending movement of the stem 3. Finally, this descending movement is transmitted to the plunger via the connector 11 or by any other means which establishes contact with the cylindrical body 2. The opening of the traveling valve 7 is forced, and not due to the difference of pressures. Therefore, the fluids which may be present within the cylinder 1 between the traveling valve 7 and the standing valve 9 do not have to be compressed. As the plunger descends said fluids flow through the traveling valve 7 and the cylindrical body 2.

Once the plunger reaches its extreme lower position and the stem 3 starts to rise, the plug 4 makes contact with its seat 5*a* in the plug ring 5 and now both rise until the plug ring 5 makes contact with its seat 6, closing the traveling valve 7. Once the traveling valve 7 closes, the ascending movement is transmitted to the plunger; all this occurs when the relative speed of the fluid at both sides of the valve 7 is zero. As the plunger rises, a drop of pressure will be created inside cylinder 1 between the traveling valve 7 and the standing valve 9 until this pressure is less than the reservoir's own pressure (the reservoir is any container or location where fluids are located), and then the standing valve 9 will open, allowing the flow of the fluids from the reservoir to the interior of the cylinder 1. Meanwhile, if an annular retention valve 8 is used, when the counterpressure and the contents of gas and/or steam in the fluid so merits it, the fluid present inside the cylinder 1 between the traveling valve 7 and the annular retention valve 8 will be compressed until the pressure in that area will be higher than the counterpressure effects and higher than the weight of the fluid column which acts on the annular retention valve 8, in which case the valve 8 opens and allows for the outflow of the fluid.

Finally, when the plunger reaches the extreme upper position and commences to descend, the standing valve 9 closes and the pumping cycle is repeated.

The advantages of the present invention are:

1. Prior to the start of the suction cycle of the plunger, the stem 3 induces movement of the plug 4 and consequently the plug ring 5, both of which are displaced toward the seat 6 of the plug ring 5 in the cylindrical body 2, and they start to close the opening of the retention valve 7. All this takes place when the relative velocity of the fluid is zero on both sides of the retention valve 7; therefore, the erosion effects of the fluid upon the components of the plunger are practically eliminated.

2. Since the traveling retention valve 7, located in the plunger, closes prior to the start of the suction of the plunger, the pumped volume is practically the maximum volume.

3. If the pumped fluid contains a high content of gases and/or steam, the fact that the traveling retention valve 7 opens in a forced manner (mechanically), and not by difference in pressures, eliminates in only one plunger stroke the possible gas and/or steam lock condition.

4. If the pump is installed so that the stem 3 is moved in a direction other than horizontal, the possibility exists that solids suspended in the fluid may be deposited on the traveling retention valve 7. The position of the plug 4 in the plunger is such that the flow of fluid can relieve said valve.

5. The plug 4 and the plug ring 5 may be designed in such a manner that the traveling valve 7 presents the maximum area of flow which is permitted with a composite retention plug and thus offers optimal fluid dynamic characteristics.

6. The plug 4 and the plug ring 5 use the cylinder 1 as a guide; therefore they act as a wiper, thus protecting the polished surface of the plunger.

7. Since the plug ring 4 touches the plug ring 5 and plug ring 5 touches seat 6, thus closing the traveling valve 7 at the beginning of the upstroke, the impact forces of the plug 4 against the plug ring 5 and of the plug ring 5 against its seat 6 are practically non-existent.

Although a preferred embodiment of the invention has been illustrated and described, it will at once be apparent to those skilled in the art that variations may be made with the scope of the invention. Accordingly it is intended that the scope of the invention not be limited by the foregoing exemplary description, but solely by the hereafter appended claims when considered in light of the relevant prior art.

I claim:

1. A positive displacement composite retention valve pump apparatus having a piston in which the actual flow equals the theoretical maximum flow through a composite traveling retention valve carried by the piston, said apparatus including, in combination, a confined fluid flow conduit, a piston adapted for reciprocal movement within the fluid flow conduit between upstream and downstream limit positions, piston reciprocating means, said piston reciprocating means having a wiper carried thereby which wipes the confined fluid flow conduit during suction movement of the episton reciprocating means, and pressure responsive check valve means located upstream with respect to the piston in the fluid flow conduit, said pressure responsive check valve means being operable to permit fluid flow therethorugh in a downstream direction toward the piston, and to preclude fluid flow therethrough in an opposite direction, said piston being composed of a plurality of parts which are relatively movable with respect to one another prior to movement of the entire piston in a direction to positively displace fluid therein, said piston including a composite traveling valve consisting of a plug, a cylinder reciprocable within the confined fluid flow conduit, and a ring located between the cylinder and the plug, said ring being arranged to make sealing engagement with the cylinder at a first seal location and to make sealing engagement wiht the plug at a second seal location, said ring having a wiper carried thereby which wipes the confined fluid flow conduit during compression movement of the piston reciprocating means, said piston reciprocating means being operatiavely connected to the plug, said composite traveling valve being arranged to close by the application of an external force to the piston reciprocating means and thereby the plug prior to suction movement of the cylinder, the plug, ring and cylinder being so proportioned that the flow area between the plug and the ring, and the flow area between the ring and the cylinder is at least equal to the flow area between the cylinder and the piston reciprocating means whereby the maximum flow area through the traveling valve is provided.

2. The positive displacement composite retention valve pump apparatus of claim 1 further characterized in that the ring includes an extension integral therewith with which the plug makes contact so as to move the ring in an upstream compression direction after said ring unseats from said cylinder.

3. The positive displacement composite retention valve pump apparatus of claim 1 further characterized by and including a second pressure responsive check valve means located downstream with respect to the plunger in the fluid flow conduit, said second pressure responsive check valve means being operable to permit fluid flow therethorugh in a downstream direction away from the plunger, and to preclude fluid flow therethrough in an opposite direction.

4. The positive displacement composite retention valve pump apparatus of claim 2 further characterized by and including a second pressure responsive check valve means located downstream with respect to the plunger in the fluid flow conduit, said second pressure responsive check valve means bein goperable ot permit fluid flow therethrough in a downstream direction away from the plunger, and to preclude fluid flow therethorugh in an opposite direction.

* * * * *